US007137481B2

(12) United States Patent
Petzl et al.

(10) Patent No.: US 7,137,481 B2
(45) Date of Patent: Nov. 21, 2006

(54) FALL ARREST DEVICE WITH LOCKING ROLLER

(75) Inventors: Paul Petzl, Barraux (FR); Christian Broquerie, Fontaine (FR)

(73) Assignee: Zedel, Crolles (FR)

( * ) Notice: Subject to any disclaimer, the term of this patent is extended or adjusted under 35 U.S.C. 154(b) by 384 days.

(21) Appl. No.: 10/880,567

(22) Filed: Jul. 1, 2004

(65) Prior Publication Data

US 2005/0082115 A1 Apr. 21, 2005

(30) Foreign Application Priority Data

Oct. 20, 2003 (FR) ..... 03 12247

(51) Int. Cl.
*A62B 1/20* (2006.01)
*B65H 59/16* (2006.01)

(52) U.S. Cl. ..... 182/192; 182/191; 182/5; 182/234; 188/65.1

(58) Field of Classification Search ..... 182/190–193, 182/234, 5–9; 188/188, 65.1, 65.4, 65.5; 254/389–391, 405
See application file for complete search history.

(56) References Cited

U.S. PATENT DOCUMENTS 4,254,941 A * 3/1981 Tanson ..... 188/65.1
4,533,026 A * 8/1985 Bernard ..... 188/65.4
4,923,037 A * 5/1990 Stephenson et al. ..... 188/188
4,938,435 A * 7/1990 Varner et al. ..... 188/65.4
6,223,868 B1 * 5/2001 Wullimann ..... 188/188
6,378,650 B1 * 4/2002 Mauthner ..... 182/5
6,382,355 B1 * 5/2002 Kowalewski ..... 182/193
6,412,602 B1 * 7/2002 Sundman ..... 254/390
6,561,313 B1 * 5/2003 Hewlett et al. ..... 182/5
6,681,891 B1 * 1/2004 Richard et al. ..... 182/5
6,732,833 B1 * 5/2004 Rogelja ..... 182/5
6,793,046 B1 * 9/2004 Petzl et al. ..... 188/188
6,814,185 B1 * 11/2004 Ostrobrod ..... 182/193
6,837,337 B1 * 1/2005 Thomas et al. ..... 182/192
6,843,346 B1 * 1/2005 LeBeau et al. ..... 182/5
6,962,238 B1 * 11/2005 Ostrobrod ..... 182/193

FOREIGN PATENT DOCUMENTS

DE 298 23 111 U1 4/1999
FR 2 422 587 11/1979
FR 2 600 898 1/1988
FR 2 748 078 10/1997

* cited by examiner

*Primary Examiner*—Hugh B. Thompson, II
(74) *Attorney, Agent, or Firm*—Oliff & Berridge, PLC

(57) ABSTRACT

A fall arrest device used with a fixed safety rope comprises a support arm articulated on a first spindle of the body, a roller in the form of a cylindrical wheel mounted rotating free on a second spindle securedly attached to the support arm, and a centrifugal coupling arranged between a drive member of the roller and the support arm so as to occupy a disengaged position or an engaged position. The centrifugal coupling comprises at least one flyweight movable along a ramp of the drive member against a compression spring, and a connecting interface engaged inside a cylindrical rim of the support arm to transmit the elastic force of the spring to the flyweight.

4 Claims, 7 Drawing Sheets

FALL ARREST DEVICE WITH LOCKING ROLLER

BACKGROUND OF THE INVENTION

The invention relates to a follower fall arrest device used with a fixed safety rope and comprising a body equipped with a securing system arranged to occupy either an active locking position in case of a fall or an inactive unlocking position enabling the user to progress along the rope in the ascending direction, or in the opposite direction when performing a controlled descent, said securing system comprising:

a support arm articulated on a first spindle of the body, a locking roller in the form of a cylindrical wheel mounted rotating free on a second spindle securedly attached to the support arm, and a centrifugal coupling means arranged between a drive member of the roller and the support arm so as to occupy a disengaged position or an engaged position.

State of the Art

In normal use for ascending or descending, fall arrest devices follow the progression of the person along the rope without causing any jamming. The person is free to move without any manual unlocking action on the fall arrest device. Locking only takes place in case of a fall.

The securing system of known fall arrest devices generally comprises a pivoting lever having at one of the ends thereof an attachment ring for connection to a harness, and at the opposite end thereof a cam for jamming the rope. Such an arrangement acts as a jamming cleat, which is liable to prevent locking if the user were to grab the lever in case of a fall.

The document WO 00/24471 relates to a two-directional locking device for a fall arrest device, comprising a locking means equipped with two cams actuated in independent manner by a common locking member in reaction to a sudden change of weight. Locking of each of the cams depends on the incline of the rope with respect to the frame of the means.

The document U.S. Pat. No. 4,923,037 describes a fall arrest device having a securing system composed of an articulated support arm which is equipped with a cylindrical wheel mounted rotating free, and with a centrifugal mechanical coupling means arranged as a pawl. The circumference of the wheel comprises a series of teeth forming a sprocket causing rotation of the wheel by friction effect with the rope. To insert the vertical lifeline in the fall arrest device, an articulated U-shaped angle bracket has to be used and the latter be made pivot outwards, which complicates operations. The use of springs in the form of pins does not enable the locking threshold of the coupling means to be controlled with precision.

OBJECT OF THE INVENTION

The object of the invention is to provide a fall arrest device for a fixed rope enabling a precise locking threshold to be achieved according to the speed or acceleration of the locking roller.

The fall arrest device according to the invention is characterized in that the centrifugal coupling means comprise at least one flyweight movable along a ramp of the drive member against a compression spring, and a connecting interface engaged inside a cylindrical rim of the support arm to transmit the elastic force of the spring to the flyweight.

In normal use for ascending or descending, the coupling means are in the disengaged position, and the fall arrest device follows the progression of the person along the rope without any manual unlocking action of the securing system. In the event of a fall, locking takes place automatically at a preset threshold. In this case, the coupling means are in the engaged position resulting in a strong pressure being exerted by the roller against the rope.

According to a preferred embodiment, the flyweight is of cylindrical shape, and operates in the engaged position in conjunction with the cylindrical rim of the support arm. The peripheral surface of the flyweight and of the ramp of the drive member is advantageously serrated so as to form a rack.

Preferably, the centrifugal coupling means comprise two flyweights and two compression springs arranged symmetrically with respect to the second spindle of the roller.

BRIEF DESCRIPTION OF THE DRAWINGS

Other advantages and features will become more clearly apparent from the following description of an embodiment of the invention given as a non-restrictive example only and represented in the accompanying drawings, in which.

DESCRIPTION OF A PREFERRED EMBODIMENT

Figure 1:
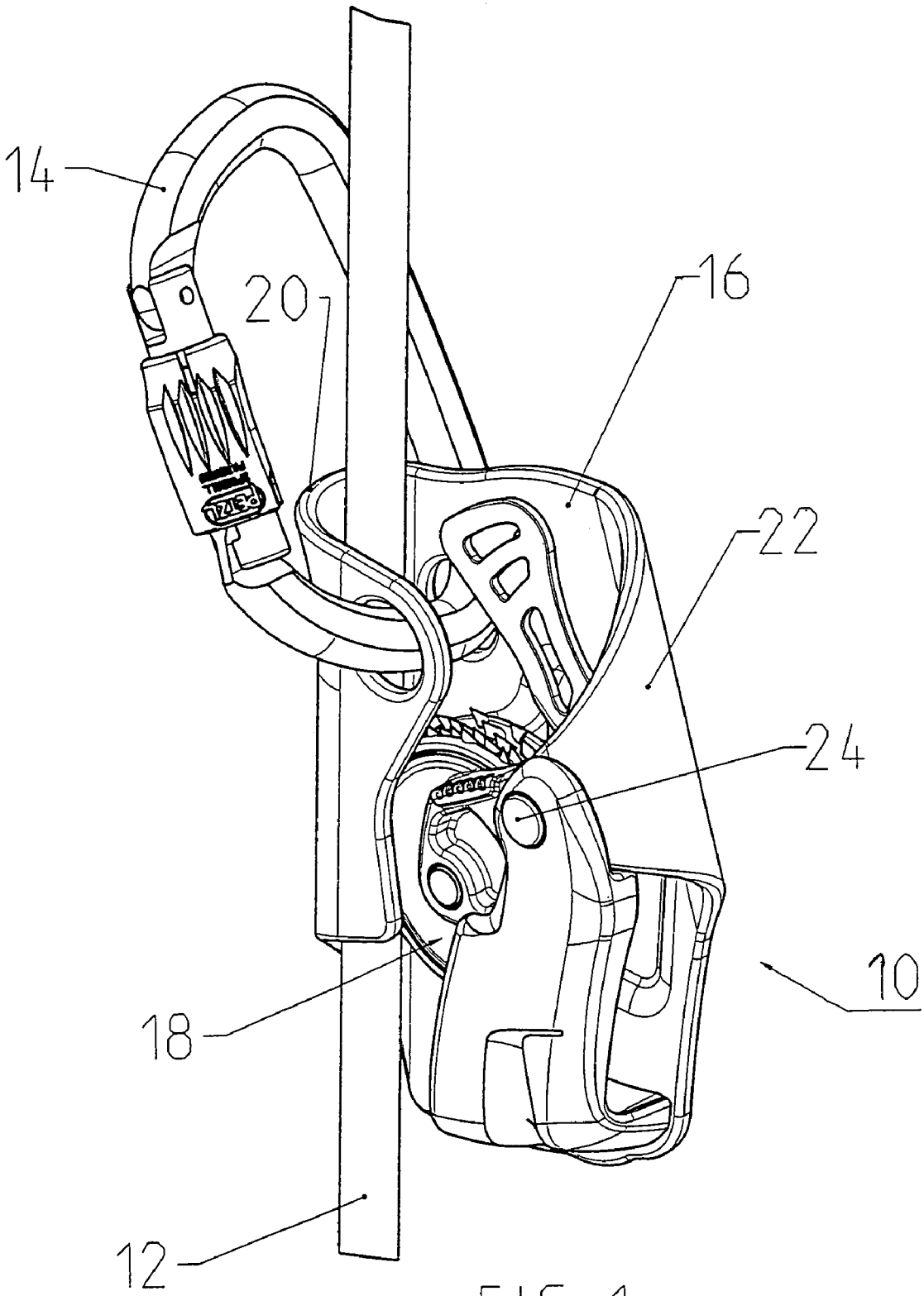
FIG. 1 is perspective view of the fall arrest device according to the invention, which is fitted on a belaying rope after an attachment snap-hook has been fitted.
Figure 2:
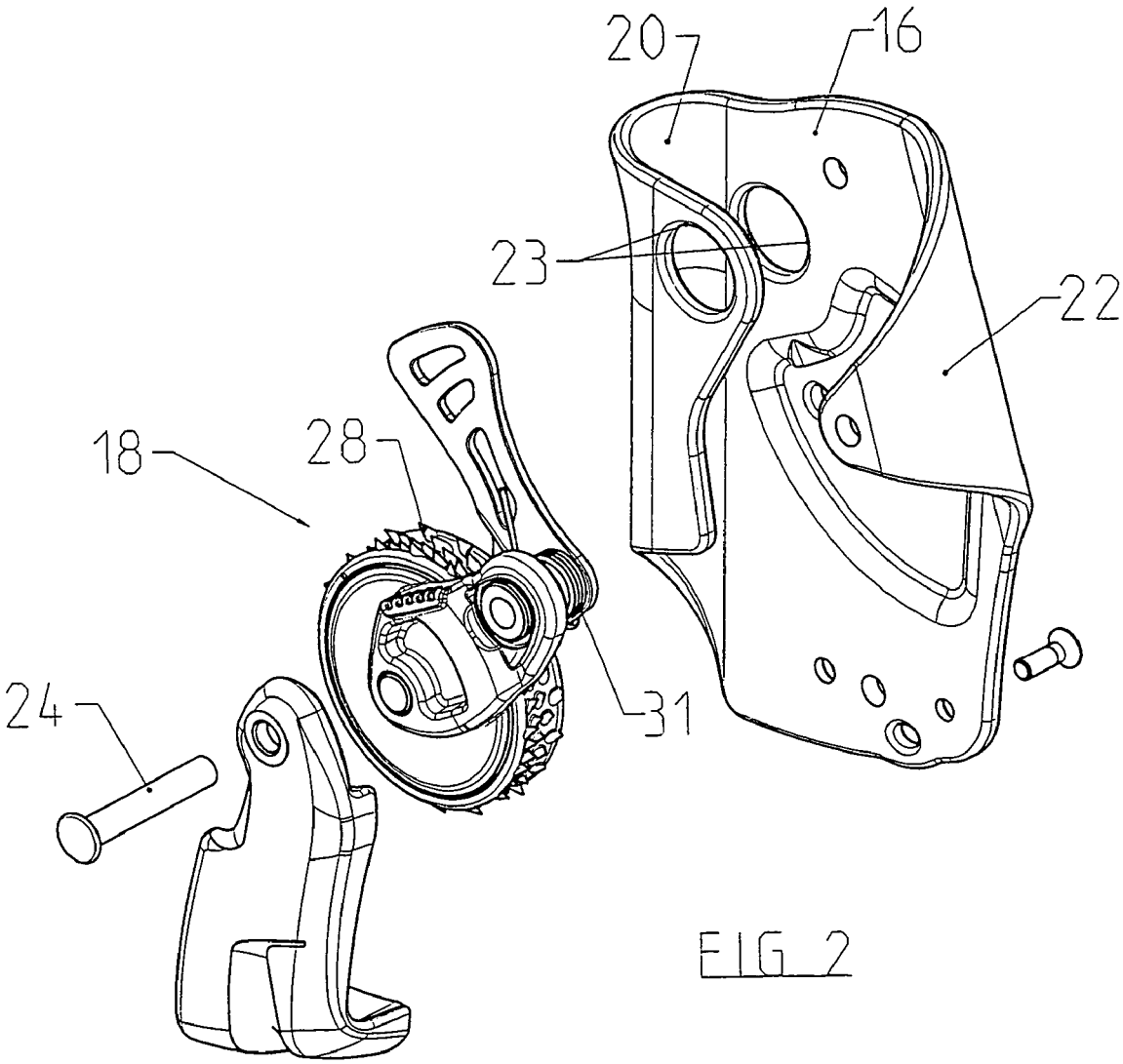
FIG. 2 shows an exploded perspective view of the fall arrest device of FIG. 1, after disassembly with respect to the rope.
Figure 3:
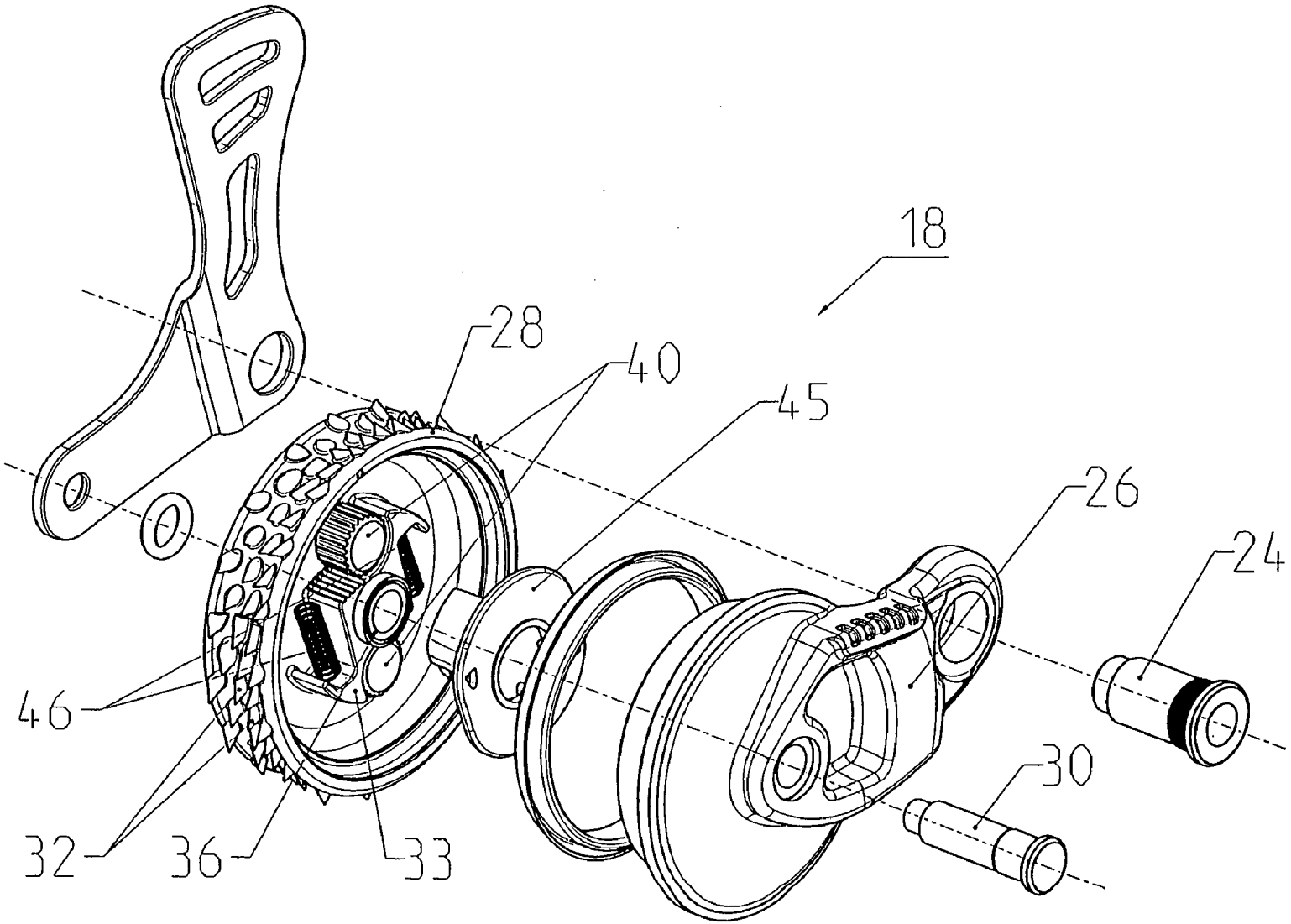
FIG. 3 is an exploded perspective view of the securing means of the fall arrest device.

In FIGS. 1 to 7, a fall arrest device 10 is used for the safety of a person moving along a fixed belaying rope 12. A snap-hook 14 is hooked onto the fall arrest device 10 so as to be connected to the body harness, either directly or via an absorption lanyard. In normal use for ascending or descending, the fall arrest device 10 follows the progression of the person along the rope 12 without causing locking. The person is then free to move without any manual unlocking action of the fall arrest device 10.

The fall arrest device 10 is composed of a rigid body 16 and a movable securing means 18 operating in conjunction with the rope 12 to occupy either an active locking position in case of a fall, or an inactive unlocking position in the ascending direction, or in the opposite direction during a controlled descent. The preferably metal body 16 comprises a straight U-shaped channel 20 for passage of the rope 12, and a bracket 22 for fitting a first spindle 24 extending transversely with respect to the direction of the channel 20. Two holes 23 are drilled in the upper part of the channel 20 to allow the snap-hook 14 to pass.

The securing means 18 comprise a support arm 26 articulated on the first spindle 24, and a locking roller 28 in the form of a wheel mounted rotating free on a second spindle 30 securedly attached to the support arm 26. The peripheral surface of the locking roller 28 is cylindrical and is equipped with a plurality of spurs 32 each having a predetermined incline with respect to the radial direction passing through the spindle 30. A tension spring 31 is threaded onto the first spindle 24 and biases the support arm 26 in the direction of the channel 20.

The locking roller 28 is equipped with an internal drive member 33, wherethrough there passes a tubular bearing 36 housing the second fixed spindle 30. Inside the locking roller 28 there is located in addition a centrifugal coupling means 38 formed by a pair of cylindrical flyweights 40 arranged between opposite ramps 42 of the drive member 33 and a circular rim 44 of the support arm 26.

Figure 4:
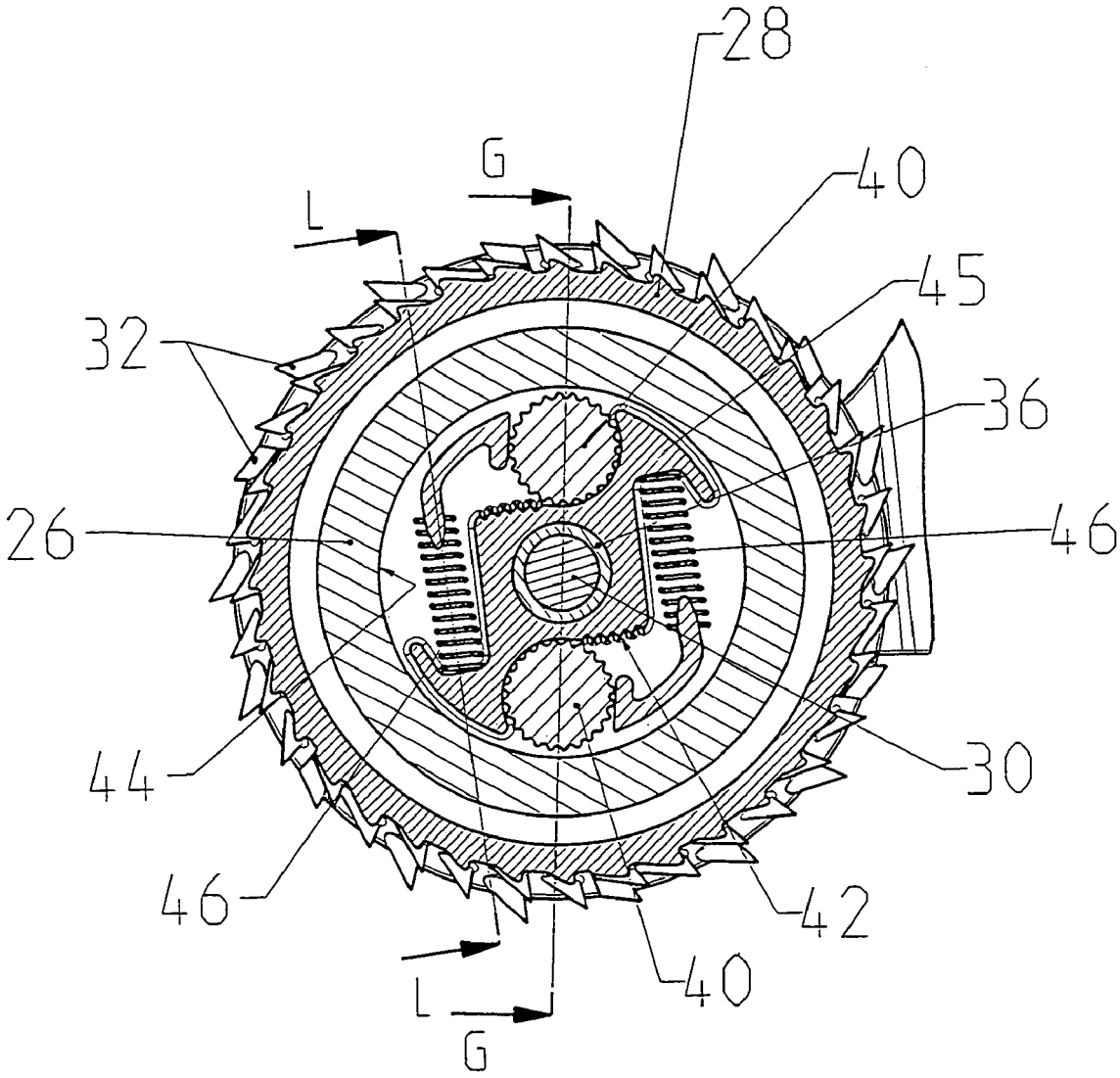
FIG. 4 is a cross-sectional view of the locking roller with the centrifugal coupling means with flyweights in the disengaged position.
Figure 5:
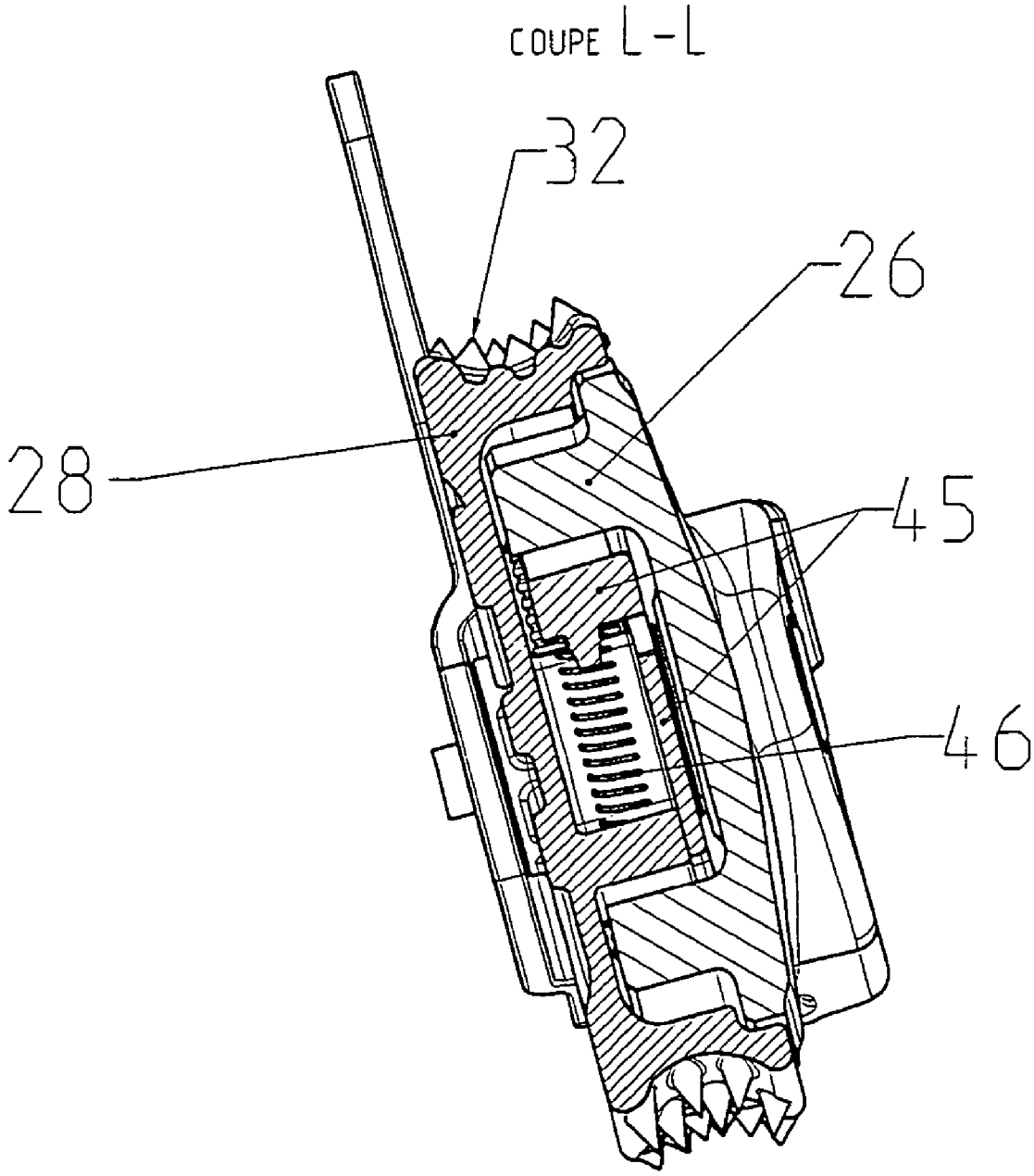
FIGS. 5 and 6 are cross-sectional views along the lines L—L and G—G of FIG. 4.
Figure 6:
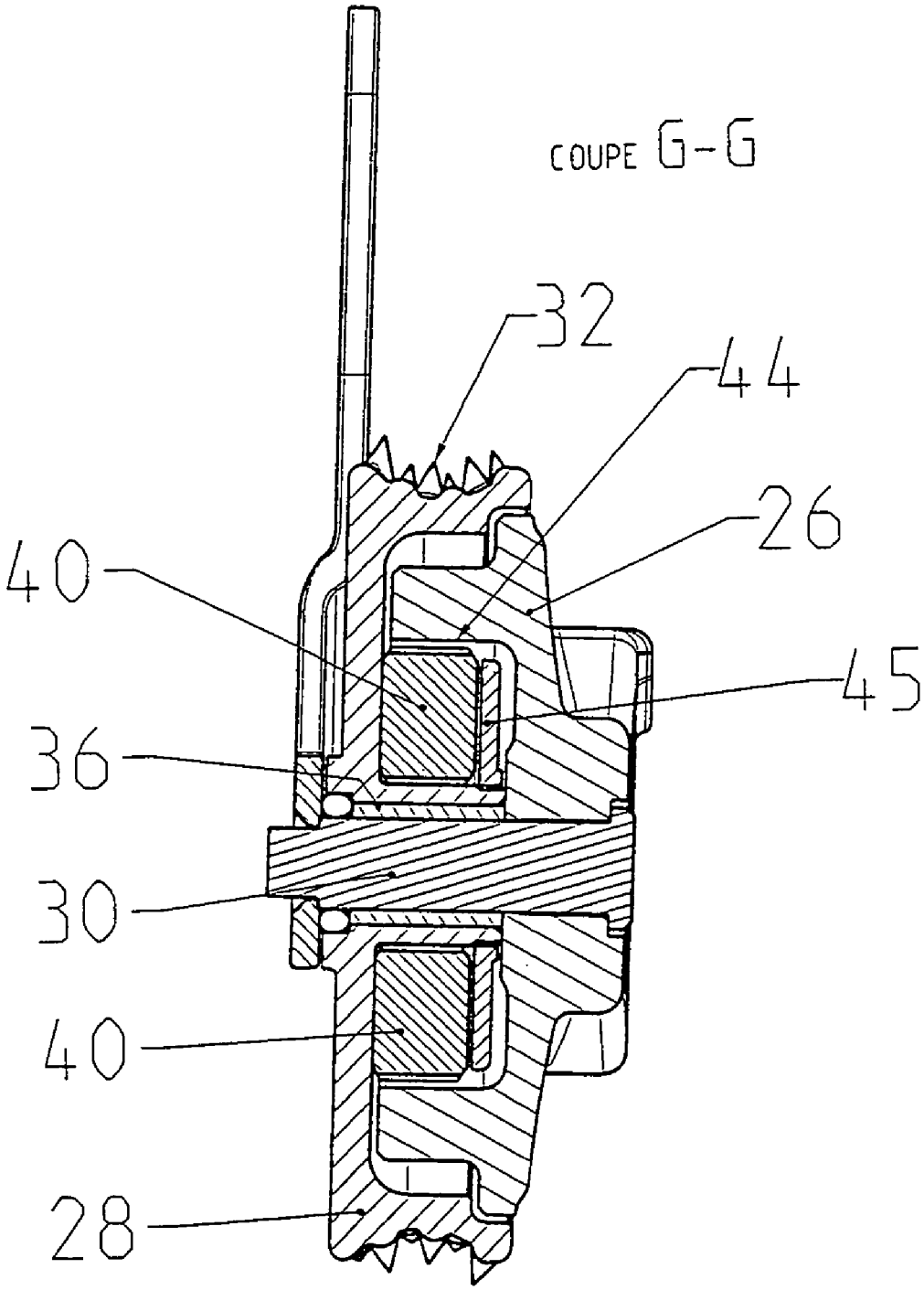

A pair of compression springs 46 biases the centrifugal coupling means 38 to the disengaged position so as to arrange a radial clearance between the flyweights 40 and the cylindrical rim 44 of the drive member 33 of the arm 26 (FIG. 4). A connecting interface 45 is engaged inside the rim 44 and transmits the relaxation forces of the springs 46 to the flyweights 40. The presence of the connecting interface 45 and of the compression springs 46 defines with precision the engagement threshold of the centrifugal coupling means 38 according to the speed or acceleration of the drive member 33 of the rotary roller 28.

Figure 7:
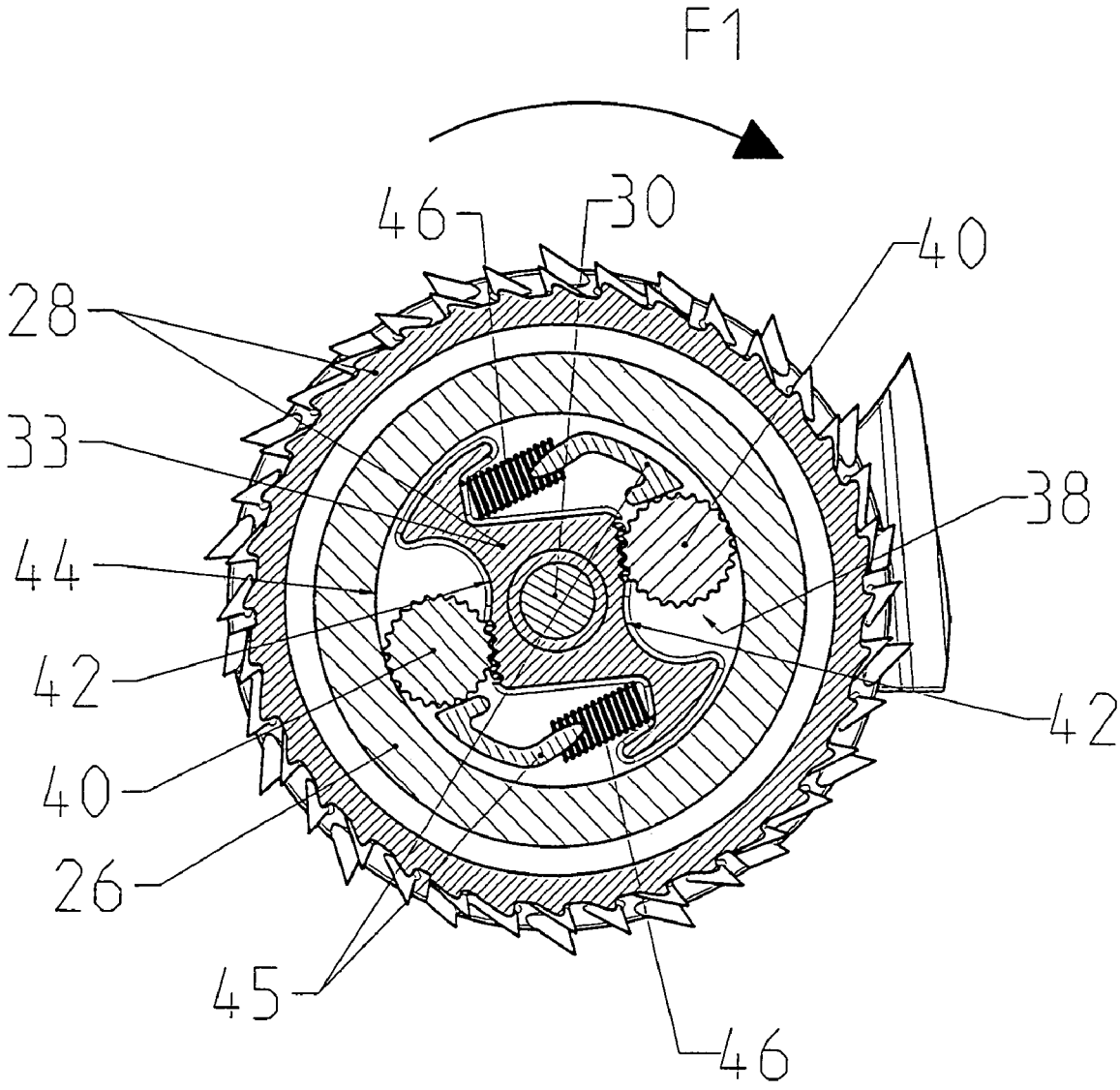
FIG. 7 is an identical view to FIG. 4 in the engaged position of the coupling means for jamming in case of a fall.

Should the user fall, fast rotation of the drive member 33 of the locking roller 28 around the second spindle 30 in the direction of the arrow F1 causes movement of the flyweights 40 by centrifugal effect to the disengaged position (FIG. 7). The flyweights 40 are subjected to a centrifugal force which is greater than and of opposite direction to the return force of the springs 46. This movement along the ramps 42 causes compression of the springs 46 and generates a jamming effect of the flyweights 40 against the rim 44. The roller 28 is thus secured to the support arm 26 so as to form a jamming cleat able to swivel around the first spindle 24 and to stop the fall by jamming the rope 12.

The peripheral surface of the flyweights 40 and of the ramps 42 of the drive member 33 is advantageously serrated so as to form a rack facilitating engagement and disengagement of the centrifugal coupling means 38. The compression springs 46 present uniform stiffnesses enabling the coupling threshold to be controlled.

The invention claimed is:

1. Fall arrest device used with a fixed safety rope and comprising a body equipped with a securing system arranged to occupy either an active locking position in case of a fall or an inactive unlocking position enabling the user to progress along the rope in the ascending direction, or in the opposite direction when performing a controlled descent, said securing system comprising:

a support arm articulated on a first spindle of the body, a roller in the form of a cylindrical wheel mounted rotating free on a second spindle securedly attached to the support arm, and a centrifugal coupling means arranged between a drive member of the roller and the support arm so as to occupy a disengaged position or an engaged position, wherein the centrifugal coupling means comprise at least one flyweight movable along a ramp of the drive member against a compression spring, and a connecting interface engaged inside a cylindrical rim of the support arm to transmit the elastic force of the spring to the flyweight.

2. Fall arrest device according to claim 1, wherein the flyweight is of cylindrical shape, and operates in the engaged position in conjunction with the cylindrical rim of the support arm.

3. Fall arrest device according to claim 2, wherein the peripheral surface of the flyweight and of the ramp of the drive member is serrated so as to form a rack.

4. Fall arrest device according to claim 1, wherein the centrifugal coupling means comprise two flyweights and two compression springs arranged symmetrically with respect to the second spindle.

* * * * *